US008348211B2

(12) United States Patent
Bauer

(10) Patent No.: US 8,348,211 B2
(45) Date of Patent: Jan. 8, 2013

(54) SECURING ATTACHMENTS TO A MEDICAL SUPPLY UNIT

(75) Inventor: Georg Bauer, Schwabhausen (DE)

(73) Assignee: Trumpf Medizin Systeme GmbH + Co. KG, Saalfeld (DE)

( * ) Notice: Subject to any disclaimer, the term of this patent is extended or adjusted under 35 U.S.C. 154(b) by 383 days.

(21) Appl. No.: 12/775,650

(22) Filed: May 7, 2010

(65) Prior Publication Data

US 2011/0116860 A1 May 19, 2011

(30) Foreign Application Priority Data

May 7, 2009 (EP) ..... 09159610

(51) Int. Cl.
*E04G 3/20* (2006.01)

(52) U.S. Cl. ..... 248/245; 248/682

(58) Field of Classification Search ..... 248/245, 248/246, 220.43, 221.11, 314, 317, 142, 248/682, 688; 606/1; 403/321, 220, 24; 439/180

See application file for complete search history.

(56) References Cited

U.S. PATENT DOCUMENTS

| | | | | |
|---|---|---|---|---|
| 4,048,768 | A * | 9/1977 | Good | 52/36.6 |
| 5,023,396 | A | 6/1991 | Bartee et al. | |
| 5,165,640 | A * | 11/1992 | Williams, 3rd | 248/220.43 |
| 5,348,485 | A | 9/1994 | Briechle et al. | |
| 5,625,537 | A | 4/1997 | Neuder | |
| 5,907,126 | A | 5/1999 | Cancellieri et al. | |
| 5,975,318 | A * | 11/1999 | Jay | 211/90.01 |
| 6,056,561 | A | 5/2000 | Lin | |
| 6,070,841 | A * | 6/2000 | Robinson | 248/220.43 |
| 6,196,649 | B1 | 3/2001 | Block et al. | |
| 6,230,910 | B1 * | 5/2001 | Olsson et al. | 211/192 |
| 6,397,886 | B1 | 6/2002 | Schopferer | |
| 7,410,379 | B1 | 8/2008 | Byrne | |
| 8,017,865 | B1 | 9/2011 | Baldwin | |
| 2004/0026589 | A1 | 2/2004 | Kreuzer et al. | |
| 2008/0074015 | A1 | 3/2008 | Parshad et al. | |
| 2009/0201632 | A1 | 8/2009 | Bauer et al. | |
| 2009/0236482 | A1 * | 9/2009 | Winig et al. | 248/220.43 |

FOREIGN PATENT DOCUMENTS

| | | | |
|---|---|---|---|
| DE | 4239625 | C1 | 8/1993 |
| DE | 29505072 | U1 | 9/1996 |
| DE | 29617895 | U1 | 2/1997 |
| DE | 19715156 | C1 | 8/1998 |
| EP | 0401556 | A1 | 12/1990 |
| EP | 0837535 | A2 | 4/1998 |
| EP | 2058911 | A1 | 11/2008 |
| FR | 2614736 | A1 | 11/1988 |
| WO | 0005530 | A1 | 2/2000 |

OTHER PUBLICATIONS

Office Action from corresponding Chinese Application No. 201010174271.0; Aug. 29, 2012; pp. 1-4.

* cited by examiner

*Primary Examiner* — Ramon Ramirez
(74) *Attorney, Agent, or Firm* — Fish & Richardson P.C.

(57) ABSTRACT

A medical supply unit is provided including at least one carrier provided with coupling devices with fixing rails. In the fixing rails, fixing elements of an adapter engage, which are locked in the fixing rail by an operating means actuated by hand by means of a locking means.

20 Claims, 6 Drawing Sheets

25
22
23
22
24
23
26
22
20
19
21
8
23
20
26
21

SECURING ATTACHMENTS TO A MEDICAL SUPPLY UNIT

CROSS REFERENCE TO RELATED APPLICATION

This application claims priority under 35 U.S.C. §119(a) to European Application No. 09 159 610.6, filed on May 7, 2009, the entire contents of which are hereby incorporated by reference.

TECHNICAL FIELD

This disclosure relates to medical supply units with lockable adapters, e.g., for accessories, which are attachable along a coupling device at various heights and which are lockable by hand.

BACKGROUND

In the medical field, in particular, in the intensive-care medicine or in the surgery, it is often necessary to operate a plurality of electrical and electronic medical apparatuses together in a spatially limited area and to arrange them such that they are located close to the patient, yet do not hinder access to the patient. Normally, this requires a certain mobility of these apparatuses as well as a flexibility of the attachment options at a medical supply unit.

Further, it is often necessary to arrange the operating elements of the medical supply unit in addition to the apparatuses in ergonomic positions such that the operating personal can easily reach and operate them but also that they may be easily attached and connected at other positions if the configuration or arrangement of the apparatuses are changed.

Medical supply units are known that include devices for receiving apparatuses, such as platforms or mounts for pump rods which are fixed using a sliding block clamped by screws inside a T-groove. Alternatively, apparatuses or accessories may be clamped at external rectangular rails or circular rods using universal adapters with clamping devices. Other attachment options for apparatuses or other accessories at the rails or rods, which are fixed to the medical supply unit, are specific adapters (i.e., not universal) by means of which the respective accessories are fixed.

Typically, the positions of the platforms or of the apparatus adapters in these attachment options are only adjustable by the use of tools to ensure a secure fastening of the apparatuses and of the accessories when the configuration or the arrangement of the apparatus equipment of the medical supply unit is changed.

Usually, operating elements of the medical supply units, such as, in particular, handles with operating buttons, are firmly arranged at platforms or other firmly attached holders. Normally, a change of the position of the operating elements is only possible by repositioning the holder of the operating element. Usually, in the case of operating elements fixed by a holder which also serves for covering signal cables, the signal cables are shielded. However, in some cases, the positioning of the operating elements exposes a suspended signal cable. Furthermore, the range in which the operating elements are adjustable depends on the length of the suspended cable. Due to the suspended cables, the hygienic conditions are not optimal, and they get worse with the enlargement of the range in which the operating elements can be displaced because longer and longer cables are used which constrains the ability of cleaning and therefore, further deteriorates the hygienic conditions.

SUMMARY

In one aspect, a device is provided to facilitate positioning medical apparatus adapters without tools, while ensuring the position is securely kept during normal use or predictable misuse.

According to an aspect of the invention, the medical supply unit includes a carrier with at least one coupling device such that the coupling device is formed as a hollow rail with an opening along its longitudinal direction. The coupling device extends along the carrier and includes at least one electrically conductive conductor rail which at least sectionally extends along the coupling device. At least one fixing rail, at least sectionally, extends along the coupling device such that a positioning rail is arranged between the opening of the hollow rail and the conductor rails.

The invention is described by means of an embodiment referring to the accompanying figures.

DETAILED DESCRIPTION

Figure 1:
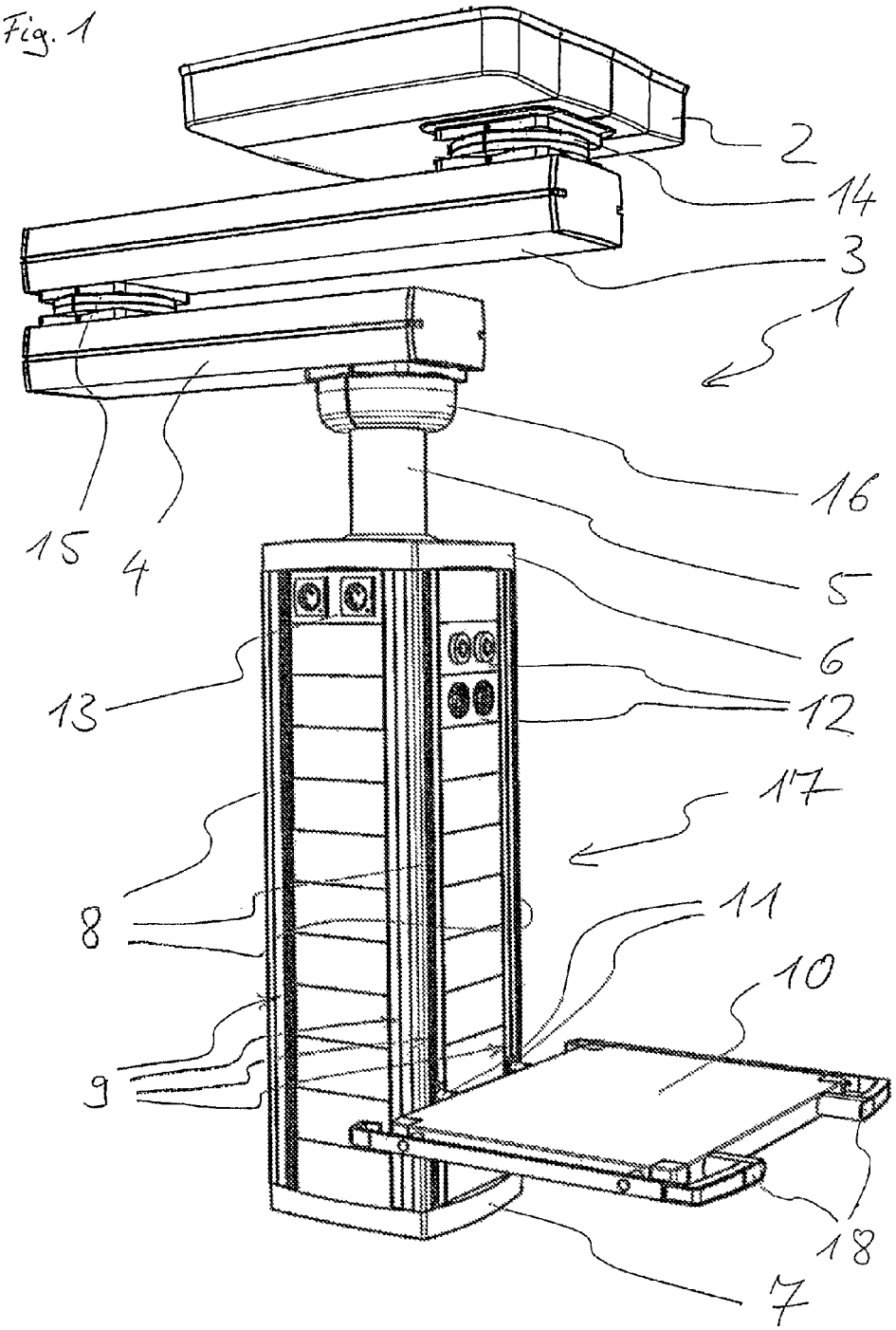
FIG. 1 is an isometric view of an embodiment of the medical supply unit configured as a ceiling mounted support.

FIG. 1 shows an isometric view of a medical supply unit 1. The medical supply unit includes a ceiling fastener covered by a ceiling cover plate 2. An upper support arm 3 is, at one end in a longitudinal direction at its upper face, connected to the ceiling fastener by an upper revolving joint with a controllable break 14. At the opposite end, the support arm 3 is connected to a lower support arm 4 by a medial revolving joint with a controllable brake 15. At the end of the lower support arm 4 which is opposite in the longitudinal direction to the medial revolving joint with controllable break 15 at its bottom side, a lower revolving joint with controllable break 16 is arranged, which is in turn connected to a distance column 5. At the lower end of the distance column 5, an upper cover plate 6 is fixed. The upper cover plate 6, a lower cover plate 7, and intermediate elements form a carrier 17.

The carrier 17 is formed in the shape of a cuboid including four longitudinal edges 8, four intermediate longitudinal faces, and an internal space. In alternative embodiments, carriers with three, five, or still more longitudinal edges and longitudinal faces are also possible. In such cases, the basic shape is cylindrical having a suitable cross-section. In other embodiments, medical supply units with several carriers can also be provided.

The coupling devices 9 extend along the longitudinal edges 8. However, the coupling devices 9 may be arranged at another location and they do not have to extend along the longitudinal edges 8. In FIG. 1, on the right-hand side of the carrier 17, an attachment option for medical apparatuses is arranged in the form of a platform 10. However, the attachment option does not have to be in the form of a platform but can also be other universally applicable attachment options or apparatus-specific attachment options. The platform 10 is fixed to the carrier by two adapters 11.

Operating elements 18 are provided in operating handles at the front corners of the platform. Rails for fixing additional apparatuses or accessories are arranged at two opposite sides, adjacent to the operating handles.

In use, the medical apparatuses are positioned or fixed on the platform 10 and/or the rails attached thereto, which, when necessary, are connected to electrical outlets integrated in an electro-installation module 13 and to gas outlets integrated in a gas-installation module 12. Carrier 17 of the medical supply unit 1 is positioned by releasing the brakes of one or several of the revolving joints with controllable brakes 14, 15, 16 using the corresponding operating elements 18 and moving the carrier 17 in the desired position and orientation. The brakes are released as long as the operating elements 18 are actuated. After the positioning, the operating elements come again to their rest position and the brakes again prevent turning of the revolving joints by means of the controllable brakes 14, 15, 16. In alternative embodiments, not all of the revolving joints are provided with controllable brakes but they are in part or totally equipped with adjustable and non-controllable brakes, or by activating one of the operating elements 18, several brakes are simultaneously released. The operating elements may also be provided for controlling other actuators such as motors for height-adjustable support arms.

Figure 2:
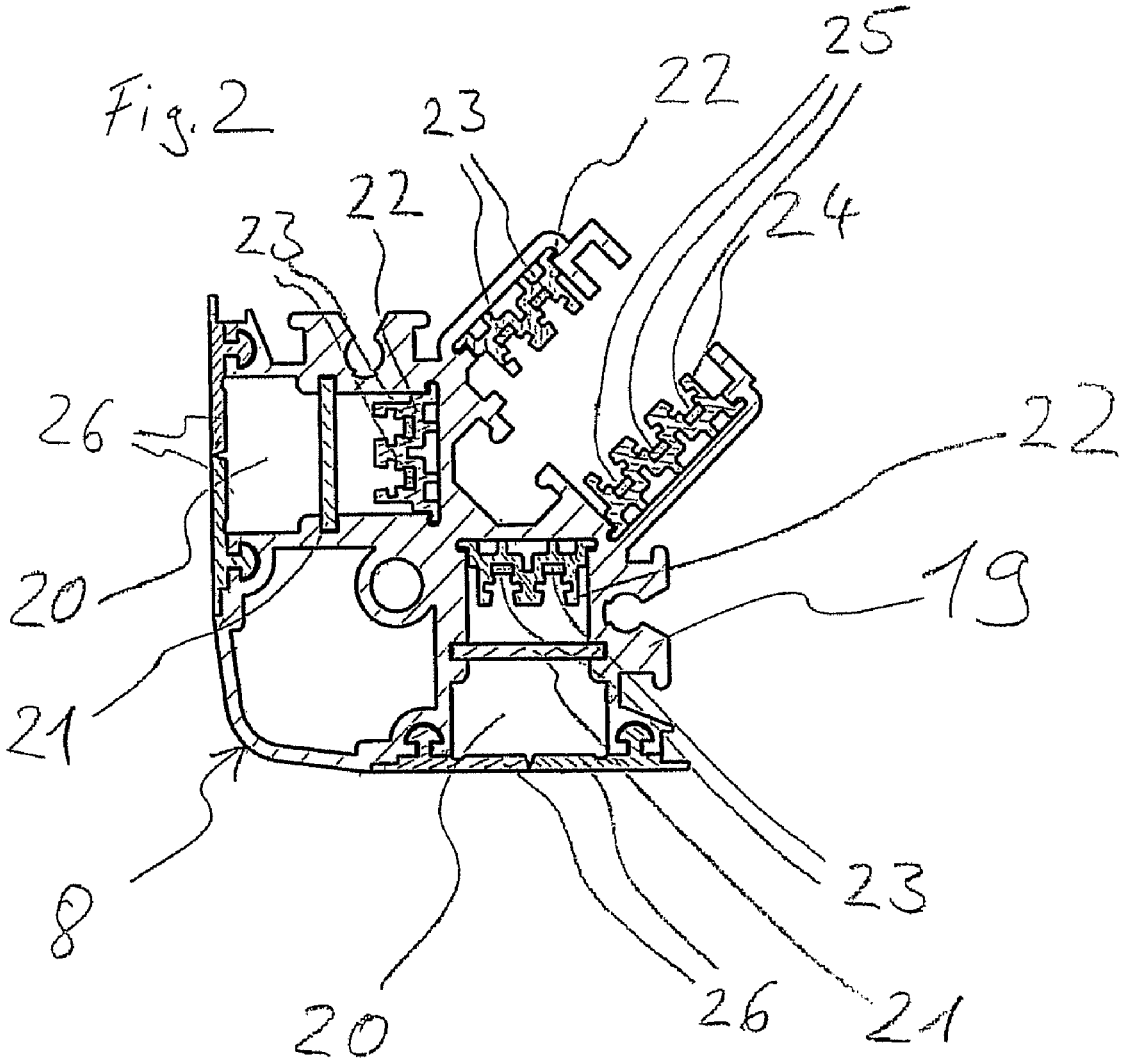
FIG. 2 shows a plan view of a portion of the carrier of the medical supply unit of FIG. 1 without any upper cover plate.

In FIG. 2, a plan view of a portion of the carrier without any upper cover plate 6 is shown. A profile 19 is an aluminum-extruded profile including different functional faces. Profile 19 can also be made in another way and of another material. Hollow rails 20 are formed on the two adjacent faces along the longitudinal edge 8.

The hollow rail 20 includes a front opening which is covered by two covering devices 26. In this embodiment, the covering devices 26 are each formed by respective lips of an elastic material, which narrow or close the opening. In alternative embodiments, covers in another configuration and in another quantity are possible such that at least one covering device is provided. When an object penetrates into the hollow rail 20, the covering devices 26 open and the penetrating object is enclosed almost without appearance of a gap between the penetrating object and the covering devices 26. In this way, the ingress of liquids such as disinfecting agents is avoided.

An isolating rail 22 having two conductor rails 23 is arranged at a face of the hollow rail 20 forming a groove-shaped recess and opposite to the covering device 26. The quantity of the conductor rails 23 within the isolating rail 22, the quantity of the isolating rails 22, and the positioning of the isolating rails 22 may be different dependent on the specific application. However, in an alternative embodiment, at least one conductor rail is provided. The isolating rails 22 are provided with groove-shaped recesses which extend along their longitudinal extension. The conductor rails 23 are provided at the base of the groove-shaped recesses. Alternatively, the conductor rails 23 may also be provided at the sides of the groove-shaped recess.

A fixing rail 21 is arranged between the front opening of the hollow rail 20 covered by the covering devices 26 and the isolating rails 22. Here, the fixing rail 21 is arranged such that the fixing rail 21 basically covers the isolation rail 22 with the conductor rails 23 in this case. In alternative embodiments, the conductor rails 23 may also be located behind the fixing rail 21 without being completely covered by it. Basically, a protection against accidental contact of the electrical contacts is achieved by this arrangement.

On the face of the profile 19 which is diagonally opposite to the longitudinal edge 8, a hollow rail in form of a groove-shaped recess is provided in the profile 19. The isolating rail 22 and an isolating rail 24 are oppositely arranged at the lateral faces of this groove-shaped recess, respectively. Here, the isolating rail 22 includes two conductor rails 23, too. Three conductor rails 25 are arranged in the isolating rail 24. A T-groove is formed at the base of the groove-shaped recess including an enlargement at each of the webs which form the opening to the T-groove. A portion of additional grooves are oppositely arranged in the entrance area of this groove-shaped recess.

In use, the conductor rails 23 are connected with a device (not shown) for data transmission. The conductor rails 23 may continuously extend along the entire length of the carrier or they may be interrupted and divided in different sections. It is thereby possible to transmit different data packets to the conductor rails 23. The conductor rails 25 are connected with a power supply device (not shown). At these conductor rails 25, the supply voltage for the electrical outlets integrated into the electro-installation module 13 or other consumers integrated into the carrier can be tapped via appropriate tapping means which are fixed in the T-groove or in the external grooves. Either of these conductor rails may also extend along the entire length of the carrier to provide a circuit across the entire length or they may be interrupted in different sections so that each section can be supplied with a separate circuit.

Figure 3:
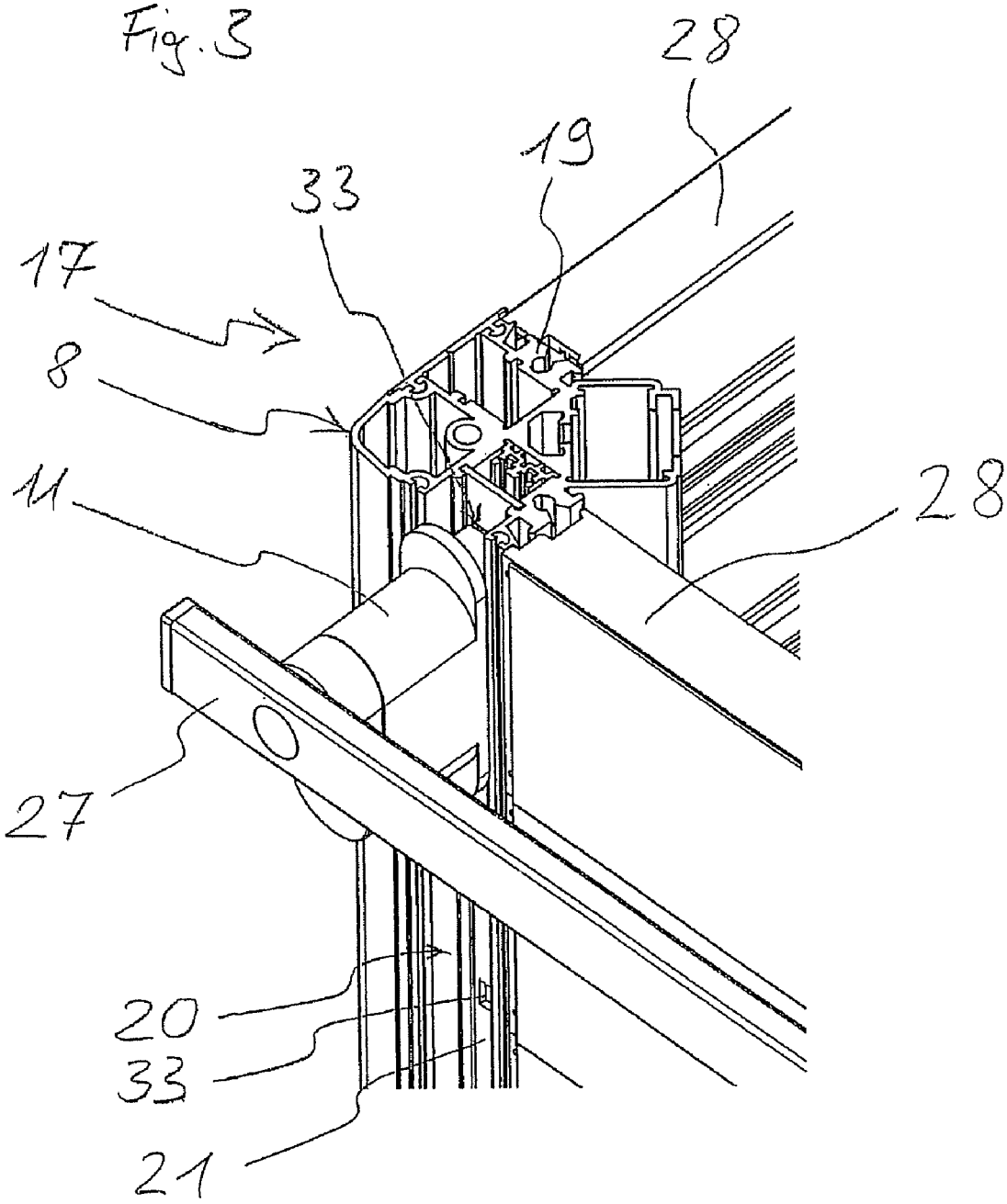
FIG. 3 shows an isometric view of a portion of the carrier without any upper cover plate with an adapter to which a fixing rail is fixed.

In FIG. 3, an isometric view of a carrier 17, without the upper cover plate 6 shown in FIG. 1, is illustrated. The adapter 11 is arranged so as to penetrate into the hollow rail 20. An accessory rail 27 is fixed to the adapter 11. The fixing rail 21 is provided with openings 33. In this embodiment, the openings 33 are rectangularly formed, however, they may have other geometries. The fastening of the adapter 11 in the fixing rail 21 is described below.

An installation module 28 is provided between the profile 19 and the—not shown—profile arranged at the next longitudinal edge. The installation module 28 can be provided with electrical outlets and, thus, form one of the electro-installation modules 13, or it can be provided with gas outlets and, thus, form one of the gas-installation modules 12. Moreover, the installation module 28 can be conducted without fixtures or with special functions such as to be a cable stowage. The installation modules 28 form a longitudinal face between the coupling devices 9.

Figure 4:
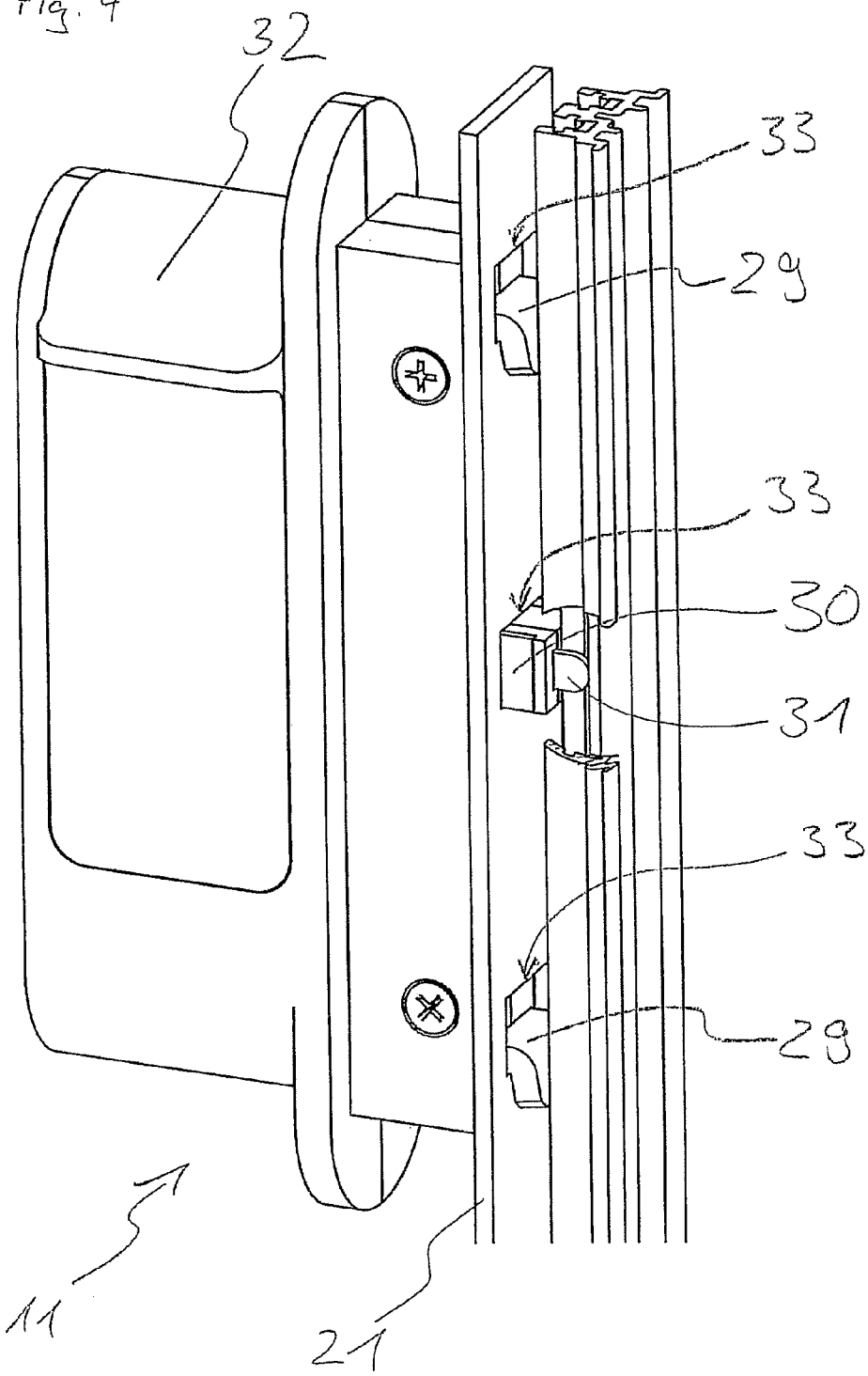
FIG. 4 shows an adapter in a position in which it is suspended and secured in a fixing rail and in which contacts of the locking device are in contact with a conductor rail.

FIG. 4 shows the adapter 11 with the fixing rail 21 in a connected arrangement. One of the two hook-shaped fixing devices 29 engages with one of the openings 33. In other embodiments, the fixing devices may assume different shapes which are able to engage with the openings in the fixing rail 21 in a positive locking manner. Basically, merely one fixing device is possible, too.

A locking device 30 engages with an additional opening 33 of the fixing rail 21 in a positive locking manner. Alternatively, non-positive means such as clamps with power assist by a toggle mechanism, or several locking devices are also possible to secure the connection. The engagement of the locking device 30 is alternatively possible in one or several openings 33.

In this embodiment, the locking device is provided with two electrical contacts 31. At least one contact is necessary, however, to ensure a safe data transmission, it is convenient to provide the locking device 30 with two contacts 31 which respectively contact one conductor rail 22 to form a conductive contact therewith. The contacts 31 are resiliently supported to compensate occurring tolerances at the adapter 11 and the coupling device 9, but, in other embodiments, they may be accordingly formed so that the contacts themselves are resilient (e.g. U-shaped). In further embodiments, the adapter 11 can also be provided without contacts 31 if its function is limited to the locking of the adapter 11 and no data transmission is provided.

Figure 5:
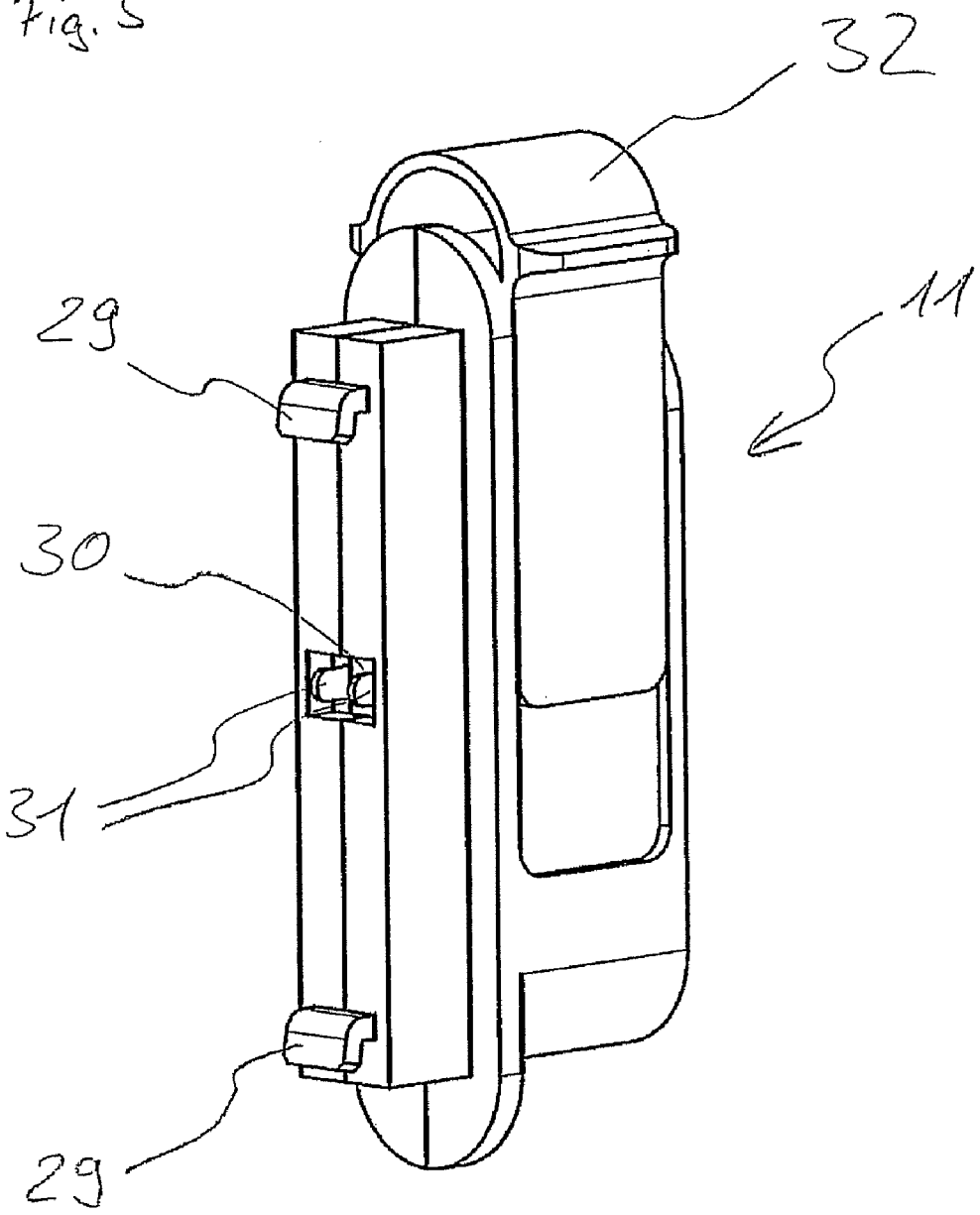
FIG. 5 is an isometric illustration of the adapter of FIG. 4 in a non-locked condition.

At the accessible area of the adapter 11 outside of the carrier 17, an operating device 32 of the locking device 30 extends from one side, in FIG. 4 the front side, via the upper side to the backside. The operating device 32 is formed such that it is operable by hand. In FIG. 5, the adapter 11 is illustrated in a condition where the operating device 32 is pulled upwards and, thereby, the locking device 30 with the contacts 31 is moved inwardly as elucidated in greater detail below.

In use, a hook on of the hook-shaped fixing device 29 of the adapter 11 is hooked into the openings 33 of the fixing rail 21. The adapter 11 may be vertically moved after the engagement of the hook-shaped fixing device. In alternative embodiments, the adapter may also be horizontally moved or it may be rotated. The adapter 11 is hooked into the openings 33 of the fixing rail 21 using the hook-shaped fixing device 29 and, subsequently, the operating device 32 is moved downwards so that the locking device 30 moves perpendicular to the longitudinal edge 8 of the carrier 17. The movement of the operating device 32 is a displacement in a direction which is perpendicular to the direction of movement of the locking device 30. By moving the operating device 32, in this embodiment downwards, the locking device 30 is moved outwards and, thus, as shown in FIG. 4, it engages into one of the openings 33 of the fixing rail 21. In this way, an upward movement of the adapter 11 is prevented and, unhooking of the hook-shaped fixing device 29 out of the openings 33 of the fixing rail 21 is safely prevented. Thus, the safe attachment without the use of a tool is possible by merely operating by hand. To further enhance the safety against unhooking, a securing device which prevents an unintentional movement of the operating device 32 is provided in an alternative embodiment. For example, a spring-loaded pin is integrated in the operating device 32, which engages in a bore in the adapter 11 and, therefore, a movement of the operating device is not allowed before the pin is intentionally pulled out of the bore.

Figure 6:
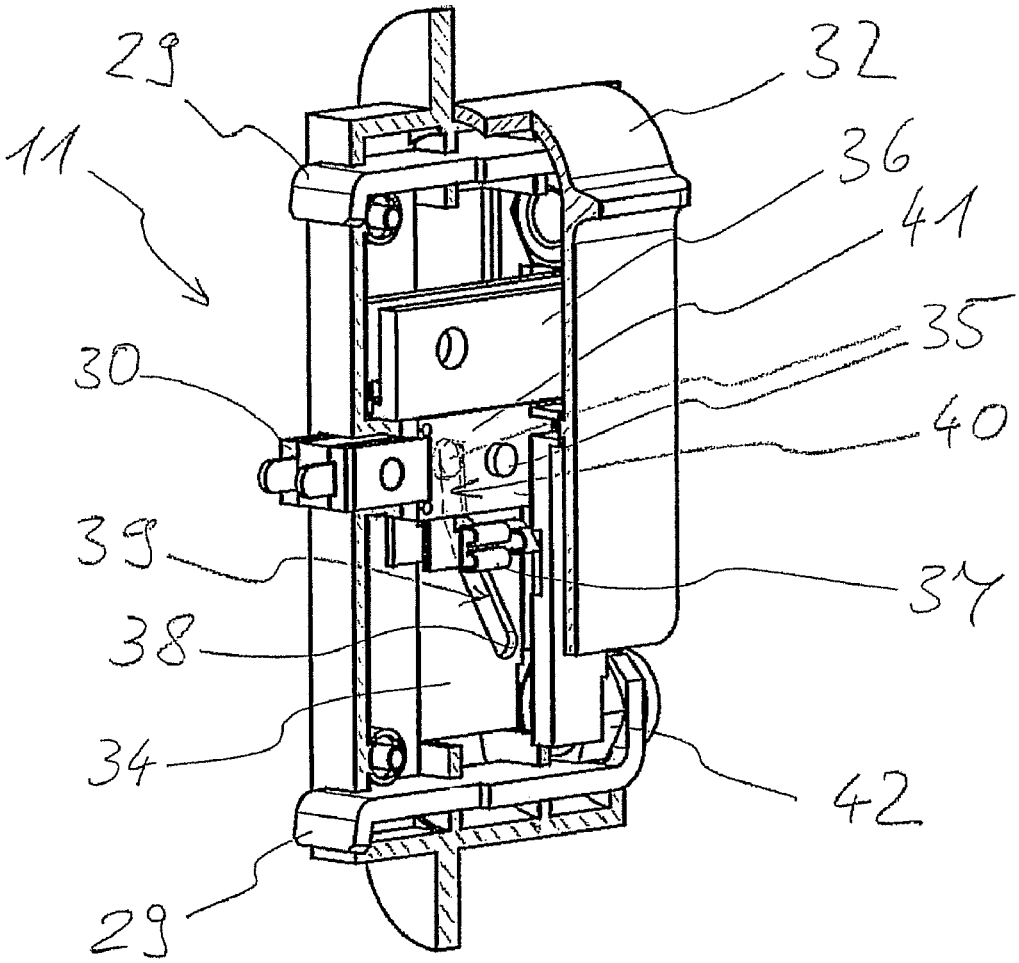
FIG. 6 shows the adapter of FIG. 4 in a partial sectional illustration.

FIG. 6 shows the adapter 11 in a partial sectional isometric view. The adapter 11 internally includes a connecting link 34 which is connected to the operating device 32. The connecting link 34 includes a guide groove 38 which includes an oblique section 39 and a vertical section 40. The oblique section 39 extends in an angle with respect to the direction of movement of the locking device 30, which is smaller than 180° and bigger than 90° and which is tilted such that a downward movement of the operating device 32 causes a movement of the locking device out of the adapter. The locking device 30 is connected with a guide plate 41 at its face which is opposite to the contacts 31. The guide plate 41 includes a bolt-shaped elevation 35 at the front side in FIG. 6 and at the backside. These bolt-shaped elevations 35 respectively engage in the guide groove 38 of the connecting link 34 which is illustrated in FIG. 6 as to be located behind the guide plate 41. Indeed, also in front of the guide plate 41, a connecting link 34 is provided in which the shown bolt-shaped elevation provided on the front side of the guide plate 41 engages. The adapter 11 further includes a guide 36 forming a linear guide for the guide plate 41.

At the bottom of the guide plate 41, two electrical contacts are provided, on which an electrical plug 37 is respectively pushed. The electrical plugs 37 are respectively connected with operating elements provided at the adapter 11 or at devices which in turn are connected to the adapter 11.

The hook-shaped fixing devices 29 extend through the adapter 11 in horizontal direction and are provided with a fixing device 42, here in form of a threaded nut, at the end which is opposite to the hook-shaped formed end. The fixing device 42 may also be conducted in another form such as to be a simple through hole or it may be arranged at another position of the hook-shaped fixing device 29.

In use, in the state of the adapter 11 in which the operating device 32 is in its upper position as shown in FIG. 5, the bolt-shaped elevation 35 is located in the oblique section 39 of the guide groove 38. Thus, the locking element 30 comes in a withdrawn state inside the adapter 11. With a downward movement of the operating device 32, the connecting link 34 is also controlled to move downward and the bolt-shaped elevation 35 is moved forward in the connecting link 38, in the leftward direction in FIG. 5, and in the hooked on condition in direction to the fixing rail 21. When the bolt-shaped elevation 35 enters into the vertical section 40 of the connecting link 38, the locking element 30 is in its extended position and it is not further moved leftwards, in the hook on condition in direction to the fixing rail 21. Due to this shape of the connecting link 38 with the vertical section 40, it is guaranteed on one hand that, when the operating device 32 is slightly lifted, the locking device 30 is not moved backward and the engagement of the locking device 30 with the fixing rail 21 is not abolished. Thus, a safe locking of the adapter 11 is ensured even when the operating device 32 is slightly lifted. On the other hand, it is prevented that, when a horizontal force occurs to the locking element 30, the connecting link 34 is pushed upwards by the bolt-shaped elevation 35 in the connecting link 38 and, thus, the locking is abolished. Therefore, a safe locking is also guaranteed if a vertical force acts upon the locking element 30. In another embodiment, the vertical section 40 of the guide groove 38 may also be tilted rightward in spite of being formed vertical as shown in FIG. 5. Thereby, indeed, with the movement of the operating device 32 and, thus, with the movement of the connecting link 34 in a downward direction, the locking element 30 is slightly moved in direction of the adapter 11, which means, in the hook on condition away from the fixing rail 21, but the abolishment of the locking due to lifting the operating device 32 is more safely avoided because when the operating device 32 is slightly lifted, the locking device 30 is moved in direction of the fixing rail 21.

In an alternative embodiment, the operating device 32 may be secured by a securing device such as a lock which is unlocked by hand before the operation of the operating device 32 or by a catch which requires an increased initial force for moving the operating device 32.

What is claimed is:

1. A medical supply unit comprising:

a carrier; and a coupling device comprising:

a hollow rail extending along the carrier and defining an opening along a longitudinal direction of the coupling device;

a conductor rail extending at least partially along the coupling device; and a fixing rail extending at least partially along the coupling device;

wherein the fixing rail is arranged between the opening of the hollow rail and the conductor rail.

2. The medical supply unit of claim 1, wherein the fixing rail covers the conductor rail.

3. The medical supply unit of claim 1, wherein the fixing rail defines openings.

4. The medical supply unit of claim 1, further comprising an isolating rail having a groove-shaped recess housing the conductor rail.

5. The medical supply unit of claim 1, further comprising a covering device configured to narrow or close the opening defined by the hollow rail.

6. The medical supply unit of claim 1, wherein the carrier comprises three longitudinal edges, three longitudinal faces, and an internal space, and wherein the coupling device extends along a longitudinal edge of the carrier.

7. An adapter for a medical supply unit carrier, the adapter comprising:

a fixing device configured to form a secure connection with the carrier, and at least one locking device which prevents releasing of the secure connection between the fixing device and the carrier, the locking device comprising an electrical contact which contacts the conductor rail of the coupling device;

wherein the adapter is configured to attach an accessory to a coupling device having a hollow rail, a conductor rail, and a fixing rail, each extending at least partially along the carrier, the fixing rail arranged between an opening defined by the hollow rail along a longitudinal direction of the coupling device and the conductor rail, and wherein the locking device is movable perpendicularly to the longitudinal edge of the carrier.

8. The adapter of claim 7, wherein the fixing device is hook-shaped and engages into an opening defined by the fixing rail.

9. The adapter of claim 7, wherein the locking device engages into an opening defined by the fixing rail.

10. The adapter of claim 7, further comprising an operating device displaceable in a direction perpendicular to a moving direction of the locking device.

11. The adapter of claim 10, further comprising:

a connecting link defining a guide groove in which an engagement portion of the locking device engages, the guide groove having a first portion arranged such that a movement of the operating device causes a movement of the locking device in a direction of the fixing rail, and a second portion arranged such that a movement of the operating device causes no movement of the locking device or a movement of the locking device away from the fixing rail;

wherein the operating device controls the connecting link.

12. The adapter of claim 10, wherein the operating device is operable by hand.

13. The adapter of claim 10, wherein the operating device comprises a securing device configured to prevent unintentional movement of the operating device.

14. The adapter of claim 7, wherein the electrical contact and the conductor rail form a resilient connection.

15. An adapter for a medical supply unit carrier, the adapter comprising:

a fixing device configured to form a secure connection with the carrier;

at least one locking device which prevents releasing of the secure connection between the fixing device and the carrier, wherein the adapter is configured to attach an accessory to a coupling device having a hollow rail, a conductor rail, and a fixing rail, each extending at least partially along the carrier, the fixing rail arranged between an opening defined by the hollow rail along a longitudinal direction of the coupling device and the conductor rail, and the locking device being movable perpendicularly to the longitudinal edge of the carrier;

an operating device displaceable in a direction perpendicular to a moving direction of the locking device; and a connecting link defining a guide groove in which an engagement portion of the locking device engages, the guide groove having a first portion arranged such that a movement of the operating device causes a movement of the locking device in a direction of the fixing rail, and a second portion arranged such that a movement of the operating device causes no movement of the locking device or a movement of the locking device away from the fixing rail, wherein the operating device controls the connecting link.

16. The adapter of claim 15, wherein the fixing device is hook-shaped and engages into an opening defined by the fixing rail.

17. The adapter of claim 15, wherein the locking device engages into an opening defined by the fixing rail.

18. The adapter of claim 15, wherein the operating device is operable by hand.

19. The adapter of claim 15, wherein the operating device comprises a securing device configured to prevent unintentional movement of the operating device.

20. An adapter for a medical supply unit carrier, the adapter comprising:

a fixing device configured to form a secure connection with the carrier, at least one locking device which prevents releasing of the secure connection between the fixing device and the carrier, wherein the adapter is configured to attach an accessory to a coupling device having a hollow rail, a conductor rail, and a fixing rail, each extending at least partially along the carrier, the fixing rail arranged between an opening defined by the hollow rail along a longitudinal direction of the coupling device and the conductor rail, and the locking device being movable perpendicularly to the longitudinal edge of the carrier; and an operating device configured to move the locking device in a first direction when the operating device is displaced in a second direction that is perpendicular to the first direction.

* * * * *